US011175077B2

(12) United States Patent
Fujiwara et al.

(10) Patent No.: US 11,175,077 B2
(45) Date of Patent: Nov. 16, 2021

(54) REFRIGERATION CYCLE APPARATUS AND ELECTRIC APPARATUS INCLUDING THE REFRIGERATION CYCLE APPARATUS

(71) Applicant: Mitsubishi Electric Corporation, Tokyo (JP)

(72) Inventors: Susumu Fujiwara, Tokyo (JP); Kosuke Sato, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 55 days.

(21) Appl. No.: 16/484,340

(22) PCT Filed: Apr. 28, 2017

(86) PCT No.: PCT/JP2017/016945

§ 371 (c)(1),
(2) Date: Aug. 7, 2019

(87) PCT Pub. No.: WO2018/198321

PCT Pub. Date: Nov. 1, 2018

(65) Prior Publication Data

US 2020/0300519 A1 Sep. 24, 2020

(51) Int. Cl.

| | |
|---|---|
| ***F25B 41/04*** | (2006.01) |
| ***F25B 41/31*** | (2021.01) |
| ***F25B 13/00*** | (2006.01) |

(52) U.S. Cl.

CPC ..... *F25B 41/31* (2021.01); *F25B 13/00* (2013.01); *F25B 2500/12* (2013.01);
(Continued)

(58) Field of Classification Search

CPC ..... F25B 41/31; F25B 13/00; F25B 2500/13; F25B 2600/2513; F25B 2700/21152;
(Continued)

(56) References Cited

U.S. PATENT DOCUMENTS 2,829,861 A * 4/1958 Wright ..... F16K 31/0655 251/129.03
2009/0278293 A1* 11/2009 Yoshinaka ..... C08K 3/34 267/140.11

(Continued)

FOREIGN PATENT DOCUMENTS

JP S58-31477 U 3/1983
JP S63-029981 Y 8/1988

(Continued)

OTHER PUBLICATIONS

Attacehd pdf file is translation of foreign reference; JP2002243312A (Year: 2002).*

(Continued)

*Primary Examiner* — Henry T Crenshaw
*Assistant Examiner* — Kamran Tavakoldavani
(74) *Attorney, Agent, or Firm* — Posz Law Group, PLC

(57) ABSTRACT

A refrigeration cycle apparatus includes an expansion device, a pipe, and a transmission sound suppressing member. The expansion device includes a valve body to control a flow rate of refrigerant. The pipe is connected to the expansion device to extend along moving directions, in controlling the flow rate of the refrigerant, of the valve body of the expansion device, and allowing the refrigerant to pass therethrough. The transmissive sound suppressing member is positioned at a first region, which is defined on an outer side of the pipe to cover at least a tip of the valve body of the expansion device, and a second region, which is continuous to the first region and is defined on an outer side of a portion of the pipe including a portion of connection to the expansion device.

13 Claims, 6 Drawing Sheets

(52) U.S. Cl.
CPC ... *F25B 2500/13* (2013.01); *F25B 2600/2513* (2013.01); *F25B 2700/21152* (2013.01)

(58) Field of Classification Search
CPC ..... F25B 2341/06; F16K 1/38; F16K 47/00; F01N 1/02; F01N 1/06; G10K 11/16; G10K 11/172; G10K 11/175
USPC ..... 62/222; 251/122
See application file for complete search history.

(56) References Cited

U.S. PATENT DOCUMENTS

| | | | | |
|---|---|---|---|---|
| 2014/0349534 | A1* | 11/2014 | Bologna | D06N 3/0056 442/120 |
| 2016/0138671 | A1* | 5/2016 | Kim | F16F 13/10 267/140.14 |
| 2019/0011157 | A1* | 1/2019 | Ohura | F25B 45/00 |
| 2019/0032978 | A1* | 1/2019 | Ohura | F25B 49/02 |

FOREIGN PATENT DOCUMENTS

| | | | | |
|---|---|---|---|---|
| JP | H06-14685 | U | | 2/1994 |
| JP | H06-194006 | A | | 7/1994 |
| JP | H07-020160 | U | | 4/1995 |
| JP | H07-120104 | A | | 5/1995 |
| JP | H09-133434 | A | | 5/1997 |
| JP | 2002-243312 | A | | 8/2002 |
| JP | 2002243312 | A | * | 8/2002 |
| JP | 2003171820 | A | * | 6/2003 |
| JP | 3533733 | B | | 3/2004 |
| JP | 2006-077131 | A | | 3/2006 |
| JP | 2009-115118 | A | | 5/2009 |
| JP | 2009-156141 | A | | 7/2009 |
| JP | 2015-089432 | A | | 5/2015 |
| JP | 2015-100667 | A | | 6/2015 |
| JP | 2016-100826 | A | | 5/2016 |

OTHER PUBLICATIONS

Office Action dated Nov. 5, 2019 issued in corresponding JP patent application No. 2018-230715 (and English translation).
Office Action dated Dec. 10, 2019 issued in corresponding JP patent application No. 2018-519895 (and English translation).
Extended European Search Report dated Mar. 23, 2020 in corresponding EP application No. 17907137.8.
International Search Report ("ISR") dated Jul. 25, 2017 issued in corresponding international patent application No. PCT/JR2017/016945 (and English translation thereof).
Examination Report dated Jun. 22, 2020 issued in corresponding IN patent application No. 201947040219.
Office Action dated Jun. 17, 2021, issued in corresponding CN Patent Application No. 201780089931.5 (and English Machine Translation).

* cited by examiner

REFRIGERATION CYCLE APPARATUS AND ELECTRIC APPARATUS INCLUDING THE REFRIGERATION CYCLE APPARATUS

CROSS REFERENCE TO RELATED APPLICATION

This application is a U.S. national stage application of PCT/JP2017/016945 filed on Apr. 28, 2017, the contents of which are incorporated herein by reference.

TECHNICAL FIELD

The present invention relates to a refrigeration cycle apparatus including an expansion device, and to an electric apparatus including the refrigeration cycle apparatus.

BACKGROUND ART

For example, as described in Patent Literature 1, in an electronic expansion valve as an example of an expansion device, liquid refrigerant flowing thereinto in a direction perpendicular to a needle valve vibrates the needle valve, generating large vibration sound. According to a technique described in Patent Literature 1, therefore, an inlet port of the liquid refrigerant is deviated in position to prevent the liquid refrigerant from directly colliding with the needle valve, to thereby suppress the vibration generated in the electronic expansion valve.

Depending on operation conditions, however, gas-phase refrigerant contained in two-phase gas-liquid refrigerant may be in the form of bubbles (substantially small microbubbles), in which case it is not possible to suppress the vibration generated in the electronic expansion valve with the above-described measure alone. That is, this is because, when the gas-phase refrigerant in the microbubble state passes through a throttle part of the electronic expansion valve, the gas-phase refrigerant collides with the throttle part and a structure, thereby exploding and generating massive destructive power. Since the gas-phase refrigerant is a mass of compressed air specific to the microbubbles, the explosion of the gas-phase refrigerant generates massive destructive power. This is related to the well-known cavitation phenomenon.

Patent Literature 2, therefore, discloses a technique of reducing vibration due to cavitation (hereinafter referred to as the cavitation noise) by mitigating an abrupt change in pressure of the refrigerant immediately after flowing out of the electronic expansion valve. Further, according to Patent Literature 2, an anti-vibration material made of rubber is wrapped around a pipe to suppress the vibration generated in the electronic expansion valve.

Further, Patent Literature 3 discloses a technique of reducing refrigerant flow sound by forming a part or all of a pipe with an acoustically transmissive material and equipping an outer circumferential portion of the acoustically transmissive material with a sound absorbing material.

CITATION LIST

Patent Literature

Patent Literature 1: Japanese Patent No. 3533733

Patent Literature 2: Japanese Unexamined Patent Application Publication No. 9-133434

Patent Literature 3: Japanese Unexamined Patent Application Publication No. 6-194006

SUMMARY OF INVENTION

Technical Problem

As in the technique of Patent Literature 2, to address specific operation conditions causing the cavitation noise, measures for suppressing the cavitation noise have been taken in the past to reduce the cavitation noise.

Even with the reduction in the cavitation noise, however, the refrigerant flow sound generated from a refrigerant circuit of a refrigeration cycle apparatus has not ceased.

As a result of investigating reasons therefor, it was found that the refrigerant flow sound generated from the refrigerant circuit is related not only to the cavitation noise and the noise due to the vibration of a part such as the needle valve, which has been reviewed in the existing art, but also to sound transmitted from the inside of the pipe to the outside of the pipe, that is, an "acoustic phenomenon." In other words, taking measures against vibration alone, as in the existing art, does not provide measures against the entire refrigerant flow sound accompanying a flow of refrigerant.

Further, intentionally forming a part or all of the pipe with an acoustically transmissive material, as in the technique of Patent Literature 3, increases the possibility of pipe rupture due to failure of the acoustically transmissive material to withstand the pressure inside the pipe. The technique of Patent Literature 3, therefore, results in an outcome compromising refrigerant circulation per se.

As described above, the refrigerant flow sound generated in the refrigerant circuit of the refrigeration cycle apparatus includes the transmissive sound transmitted from the inside of the pipe to the outside of the pipe owing to the state of the refrigerant flowing through the pipe, as well as the vibration sound generated from the vibration of a part caused by the refrigerant flowing through the pipe. Therefore, measures against vibration alone, as in the existing art, only reduce the propagation of vibration, failing to reduce the entire refrigerant flow sound.

The present invention has been made with the above-described issue as background, and aims to provide a refrigeration cycle apparatus and an electric apparatus including the refrigeration cycle apparatus capable of reducing the entire refrigerant flow sound by taking measures against the transmissive sound transmitted from the inside of the pipe to the outside of the pipe owing to the state of the refrigerant flowing through the pipe.

Solution to Problem

A refrigeration cycle apparatus according to an embodiment of the present invention includes: an expansion device including a valve body, the valve body being configured to control a flow rate of refrigerant; a pipe connected to the expansion device to extend along moving directions, in controlling the flow rate of the refrigerant, of the valve body of the expansion device, the pipe being configured to allow the refrigerant to pass therethrough; and a transmissive sound suppressing member positioned at a first region and a second region, the first region being defined on an outer side of the pipe, the first region covering a tip of the valve body of the expansion device, the second region being continuous to the first region and being defined on an outer side of a portion of the pipe, the portion comprising a portion of connection to the expansion device.

An electric apparatus according to an embodiment of the present invention includes the above-described refrigeration cycle apparatus.

Advantageous Effects of Invention

The refrigeration cycle apparatus according to the embodiment of the present invention includes the transmissive sound suppressing member positioned at the first region and the second region. With the transmissive sound suppressing member, therefore, the refrigeration cycle apparatus is capable of suppressing the transmissive sound transmitted from the inside of the refrigerant pipe to the outside of the refrigerant pipe owing to the state of the refrigerant flowing through the refrigerant pipe, and is consequently capable of reducing the refrigerant flow sound.

The electric apparatus according to the embodiment of the present invention includes the above-described refrigeration cycle apparatus, and thus effectively reduces the refrigerant flow sound generated in the refrigerant circuit.

DESCRIPTION OF EMBODIMENTS

Embodiment of the invention will be described below based on the drawings. In the following drawings including FIG. 1, the dimensional relationships between component members may be different from actual relationships. Further, in the following drawings including FIG. 1, component members denoted with identical signs are identical or equivalent to each other, which applies throughout the specification. Further, the forms of component elements described throughout the text of the specification are basically illustrative, and forms of component elements are not limited to these described ones.

Figure 1:
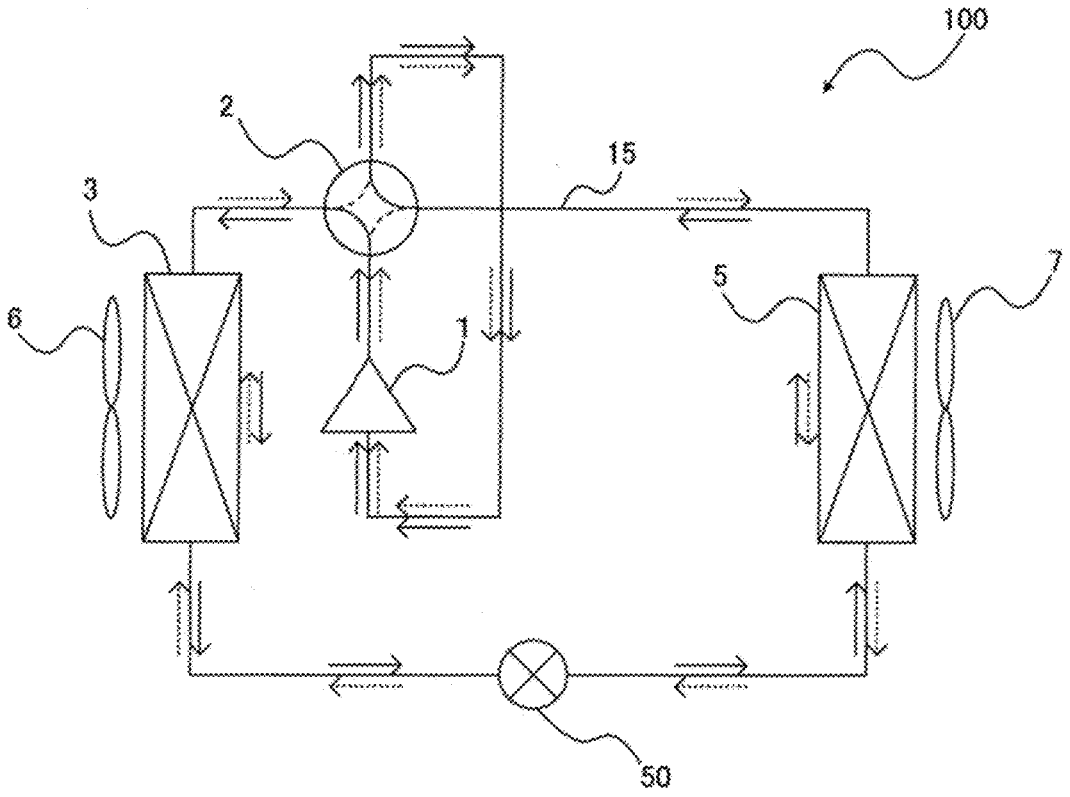
FIG. 1 is a schematic configuration diagram illustrating an example of the configuration of a refrigerant circuit in a refrigeration cycle apparatus according to Embodiment of the present invention.

FIG. 1 is a schematic configuration diagram illustrating an example of the configuration of a refrigerant circuit in a refrigeration cycle apparatus 100 according to Embodiment of the present invention. FIG. 1 illustrates an example in which the refrigeration cycle apparatus 100 is included in an air-conditioning apparatus as an example of an electric apparatus. Further, in FIG. 1, solid arrows represent a flow of refrigerant in a cooling operation, and broken arrows represent a flow of refrigerant in a heating operation.

<Configuration of Refrigeration Cycle Apparatus 100>

As illustrated in FIG. 1, the refrigeration cycle apparatus 100 includes a refrigerant circuit in which a compressor 1, a flow switching device 2, a first heat exchanger (heat source-side heat exchanger) 3, an electronic expansion valve 50, and a second heat exchanger (load-side heat exchanger) 5 are connected by refrigerant pipes 15.

FIG. 1 illustrates, as an example, the refrigeration cycle apparatus 100 equipped with the flow switching device 2 to be able to switch between the cooling operation and the heating operation with the flow switching device 2. The refrigeration cycle apparatus 100, however, may not be equipped with the flow switching device 2, to thereby provide a fixed flow of refrigerant.

The compressor 1, the flow switching device 2, the first heat exchanger 3, and the electronic expansion valve 50 are mounted in a heat source-side unit (an outdoor unit), for example. The heat source-side unit is installed in a space different from an air-conditioning target space (outdoors, for example), and has a function of supplying cooling energy or heating energy to a load-side unit.

The second heat exchanger 5 is mounted in the load-side unit (a use-side unit or an indoor unit), for example. The load-side unit is installed in a space for supplying the cooling energy or the heating energy to the air-conditioning target space (indoors, for example), and has a function of cooling or heating the air-conditioning target space with the cooling energy or the heating energy supplied from the heat source-side unit.

The compressor 1 compresses refrigerant and discharges the compressed refrigerant. The compressor 1 may be formed as a rotary compressor, a scroll compressor, a screw compressor, or a reciprocating compressor, for example. When the first heat exchanger 3 functions as a condenser, the refrigerant discharged from the compressor 1 is sent to the first heat exchanger 3 through the refrigerant pipes 15. When the first heat exchanger 3 functions as an evaporator, the refrigerant discharged from the compressor 1 is sent to the second heat exchanger 5 through the refrigerant pipes 15.

The flow switching device 2 is disposed on a discharge side of the compressor 1 to switch the flow of refrigerant between the heating operation and the cooling operation. The flow switching device 2 may be formed as a four-way valve or a combination of three-way valves or two-way valves, for example.

The first heat exchanger 3 functions as an evaporator in the heating operation, and functions as a condenser in the cooling operation. The first heat exchanger 3 may be formed as a fin-and-tube heat exchanger, for example.

The first heat exchanger 3 is equipped with a first air-sending device 6. The first air-sending device 6 supplies the first heat exchanger 3 with air, which is heat-exchanging fluid. The first air-sending device 6 may be formed as a propeller fan having a plurality of blades, for example.

The electronic expansion valve 50 is an example of an expansion device, and reduces the pressure of the refrigerant passing through the second heat exchanger 5 or the first heat exchanger 3. The electronic expansion valve 50 may be mounted not in the heat source-side unit but in the load-side unit. The electronic expansion valve 50 will be specifically described later. Further, although the electronic expansion valve 50 will be described as an example of the expansion device, the expansion device is not limited to the electronic expansion valve 50. The expansion device may be any expansion device having a valve body that controls the flow rate of the refrigerant, and the type of expansion device is not particularly limited.

The second heat exchanger 5 functions as a condenser in the heating operation, and functions as an evaporator in the cooling operation. The second heat exchanger 5 may be formed as a fin-and-tube heat exchanger, for example.

The second heat exchanger 5 is equipped with a second air-sending device 7. The second air-sending device 7 supplies the second heat exchanger 5 with air, which is heat-exchanging fluid. The second air-sending device 7 may be formed as a propeller fan having a plurality of blades, for example.

<Operations of Refrigeration Cycle Apparatus 100>

Operations of the refrigeration cycle apparatus 100 will now be described with reference to flows of refrigerant. Herein, operations of the refrigeration cycle apparatus 100 will be described with an example in which heat-exchanging fluid is air and heat-exchanged fluid is refrigerant.

The cooling operation performed by the refrigeration cycle apparatus 100 will first be described.

The compressor 1 is driven to discharge high-temperature, high-pressure, gas-state refrigerant from the compressor 1. Then, the refrigerant flows along the solid arrows. The high-temperature, high-pressure gas refrigerant (single phase) discharged from the compressor 1 flows into the first heat exchanger 3, which functions as the condenser, via the flow switching device 2. The first heat exchanger 3 exchanges heat between the high-temperature, high-pressure gas refrigerant flowing therein and the air supplied by the first air-sending device 6, and the high-temperature, high-pressure gas refrigerant is condensed into high-pressure liquid refrigerant (single phase).

The high-pressure liquid refrigerant sent from the first heat exchanger 3 is expanded by the electronic expansion valve 50 into refrigerant in the gas-liquid two-phase state containing low-pressure gas refrigerant and liquid refrigerant. The two-phase gas-liquid refrigerant flows into the second heat exchanger 5, which functions as the evaporator. The second heat exchanger 5 exchanges heat between the two-phase gas-liquid refrigerant flowing therein and the air supplied by the second air-sending device 7, and the liquid refrigerant in the two-phase gas-liquid refrigerant evaporates, turning the two-phase gas-liquid refrigerant into low-pressure gas refrigerant (single phase). With this heat exchange, the air-conditioning target space is cooled. The low-pressure gas refrigerant sent from the second heat exchanger 5 flows into the compressor 1 via the flow switching device 2 to be compressed into high-temperature, high-pressure gas refrigerant, and is discharged again from the compressor 1. Then, this cycle is repeated.

The heating operation performed by the refrigeration cycle apparatus 100 will now be described.

The compressor 1 is driven to discharge high-temperature, high-pressure, gas-state refrigerant from the compressor 1. Then, the refrigerant flows along the broken arrows. The high-temperature, high-pressure gas refrigerant (single phase) discharged from the compressor 1 flows into the second heat exchanger 5, which functions as the condenser, via the flow switching device 2. The second heat exchanger 5 exchanges heat between the high-temperature, high-pressure gas refrigerant flowing therein and the air supplied by the second air-sending device 7, and the high-temperature, high-pressure gas refrigerant is condensed into high-pressure liquid refrigerant (single phase). With this heat exchange, the air-conditioning target space is heated.

The high-pressure liquid refrigerant sent from the second heat exchanger 5 is expanded by the electronic expansion valve 50 into refrigerant in the two-phase, gas-liquid state containing low-pressure gas refrigerant and liquid refrigerant. The two-phase gas-liquid refrigerant flows into the first heat exchanger 3, which functions as the evaporator. The first heat exchanger 3 exchanges heat between the two-phase gas-liquid refrigerant flowing therein and the air supplied by the first air-sending device 6, and the liquid refrigerant in the two-phase gas-liquid refrigerant evaporates, turning the two-phase gas-liquid refrigerant into low-pressure gas refrigerant (single phase). The low-pressure gas refrigerant sent from the first heat exchanger 3 flows into the compressor 1 via the flow switching device 2 to be compressed into high-temperature, high-pressure gas refrigerant, and is discharged again from the compressor 1. Then, this cycle is repeated.

<Configuration of Electronic Expansion Valve 50>

Figure 2:
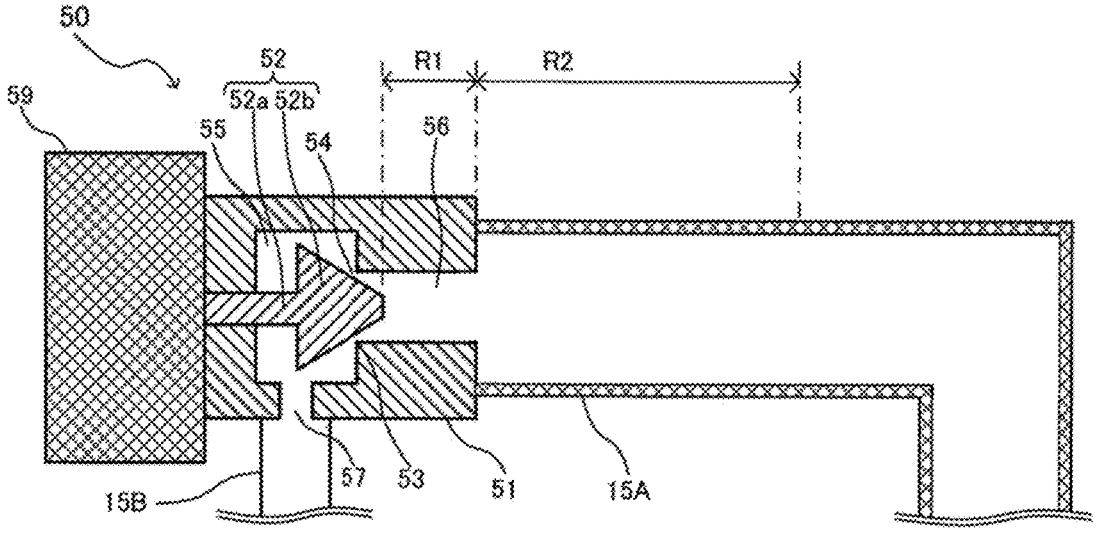
FIG. 2 is a schematic sectional view schematically illustrating a configuration example of an electronic expansion valve included in the refrigeration cycle apparatus according to Embodiment of the present invention.

FIG. 2 is a schematic sectional view schematically illustrating a configuration example of the electronic expansion valve 50 included in the refrigeration cycle apparatus 100. A configuration of the electronic expansion valve 50 will be described based on FIG. 2. In the refrigerant pipes 15 connected to the electronic expansion valve 50 in FIG. 2, the refrigerant pipe 15 connected to the electronic expansion valve 50 to extend along moving directions, in controlling the flow rate of the refrigerant, of a valve body 52 of the electronic expansion valve 50 is illustrated as a first pipe 15A, and the refrigerant pipe 15 connected to the electronic expansion valve 50 to be perpendicular to the moving directions of the valve body 52 of the electronic expansion valve 50 is illustrated as a second pipe 15B.

The electronic expansion valve 50 includes a main body 51, the valve body 52 movably disposed inside the main body 51, and a driving device 59 that drives the valve body 52.

The main body 51 is formed by cutting a brass cast, for example. The main body 51 includes therein a valve chamber 55 in which the valve body 52 is disposed to be able to reciprocate. The refrigerant flows into the valve chamber 55. The second pipe 15B is connected to a lateral surface of the main body 51 (a wall portion positioned perpendicular to the moving directions of the valve body 52). The second pipe 15B communicates with the valve chamber 55 through a through-hole 57 formed in the lateral surface of the main body 51. That is, the through-hole 57 functions as an inlet-outlet port of the refrigerant.

The first pipe 15A is connected to a bottom portion of the main body 51 (a wall portion positioned along the moving directions of the valve body 52). The first pipe 15A communicates with the valve chamber 55 through a through-hole 56 formed in the bottom portion of the main body 51. That is, the through-hole 56 functions as an inlet-outlet port of the refrigerant. A peripheral portion of the main body 51 around the through-hole 56 near the valve chamber 55 functions as a valve seat 53.

The valve body 52 includes a cylindrical portion 52*a* and a conical portion 52*b* integrally formed together, and is disposed to be able to reciprocate to and from the through-hole 56. The cylindrical portion 52*a* forms a shaft portion of the valve body 52, and is coupled to the driving device 59. A tip end portion of the conical portion 52*b* is inserted in and extracted from the through-hole 56 to form a ring-shaped throttle part 54 with the conical portion 52*b* and the valve seat 53. That is, with the valve body 52 reciprocating, the opening area of the throttle part 54 is changed, making it possible to control the flow rate of the refrigerant. The conical portion 52*b* is not required to have a strictly conical shape. It suffices if the conical portion 52*b* has a tapered shape (a shape reduced in diameter toward the first pipe 15A).

The driving device 59 is disposed on a side of the main body 51 opposite to a side of the main body 51 connected to the first pipe 15A. With the driving device 59, the valve body 52 moves in the valve chamber 55 in horizontal directions on the drawing sheet. Further, a passage area (the cross-sectional area of a passage) of the throttle part 54, which is a ring-shaped minute passage formed with the valve seat 53 and the valve body 52, is changed depending on the position of the valve body 52. That is, the opening degree of the through-hole 56 is adjusted depending on the position of the valve body 52.

A description will be given of operations of the electronic expansion valve 50 configured as described above. As illustrated in FIG. 1, the electronic expansion valve 50 is installed between the first heat exchanger 3 and the second heat exchanger 5 as a component element of the refrigeration cycle apparatus 100. With the installation of the electronic expansion valve 50, therefore, the two-phase gas-liquid refrigerant flows in from the first pipe 15A or the second pipe 15B.

A description will first be given of an operation of the electronic expansion valve 50 when the two-phase gas-liquid refrigerant flows in from the first pipe 15A. That is, in FIG. 2, an operation of the electronic expansion valve 50 will be described with an example in which the refrigerant flows from the right side of the drawing sheet to the left side of the drawing sheet.

The two-phase gas-liquid refrigerant flows into the main body 51 of the electronic expansion valve 50 from the first pipe 15A. The two-phase gas-liquid refrigerant flowing into the main body 51 from the first pipe 15A collides with the valve body 52. The valve body 52, with which the two-phase gas-liquid refrigerant collides, vibrates and generates vibration sound.

Further, when the two-phase gas-liquid refrigerant flows in from the second pipe 15B, the two-phase gas-liquid refrigerant flows into the main body 51 of the electronic expansion valve 50 from the second pipe 15B. The two-phase gas-liquid refrigerant flowing into the main body 51 from the second pipe 15B collides with the valve body 52. The valve body 52, with which the two-phase gas-liquid refrigerant collides, vibrates and generates vibration sound. It is possible to prevent the two-phase gas-liquid refrigerant from directly colliding with the valve body 52 by positioning the second pipe 15B such that a connection position thereof is deviated. This method, however, does not serve as a measure against the cavitation noise.

The refrigerant flowing in from the second pipe 15B forms a swirl flow around the valve body 52 in the valve chamber 55. Consequently, the liquid refrigerant and the gas refrigerant are likely to be unevenly distributed to the outer circumferential side and the inner circumferential side, respectively. Thereafter, the refrigerant flows into the throttle part 54 after travelling a short distance.

In general, when the two-phase gas-liquid refrigerant flows into the electronic expansion valve 50 from the second pipe 15B, there is a certain distance to travel for the refrigerant to reach the throttle part 54 after flowing into the valve chamber 55, and thus the flow of refrigerant is disturbed.

A description will now be given of an operation of the electronic expansion valve 50 when the liquid refrigerant flows in from the first pipe 15A.

The liquid refrigerant flows into the main body 51 of the electronic expansion valve 50 from the first pipe 15A. Since only the liquid refrigerant is present in the valve chamber 55, the refrigerant flow sound is unlikely to be generated in the throttle part 54. After the liquid refrigerant passes through the throttle part 54, however, gas refrigerant (air bubbles) may be generated in a non-equilibrium state by the cavitation, for example. That is, with the liquid refrigerant turning into the two-phase gas-liquid refrigerant, the cavitation noise is generated. The refrigerant thereafter changes the flow direction thereof in the valve chamber 55, and is discharged from the second pipe 15B.

A similar operation also takes place when the liquid refrigerant flows in from the second pipe 15B.

As described above, vibration and noise are generated in the electronic expansion valve 50 regardless of whether the refrigerant flows in from the first pipe 15A or from the second pipe 15B.

<Refrigerant Flow Sound Generated from Refrigerant Circuit>

Figure 3:
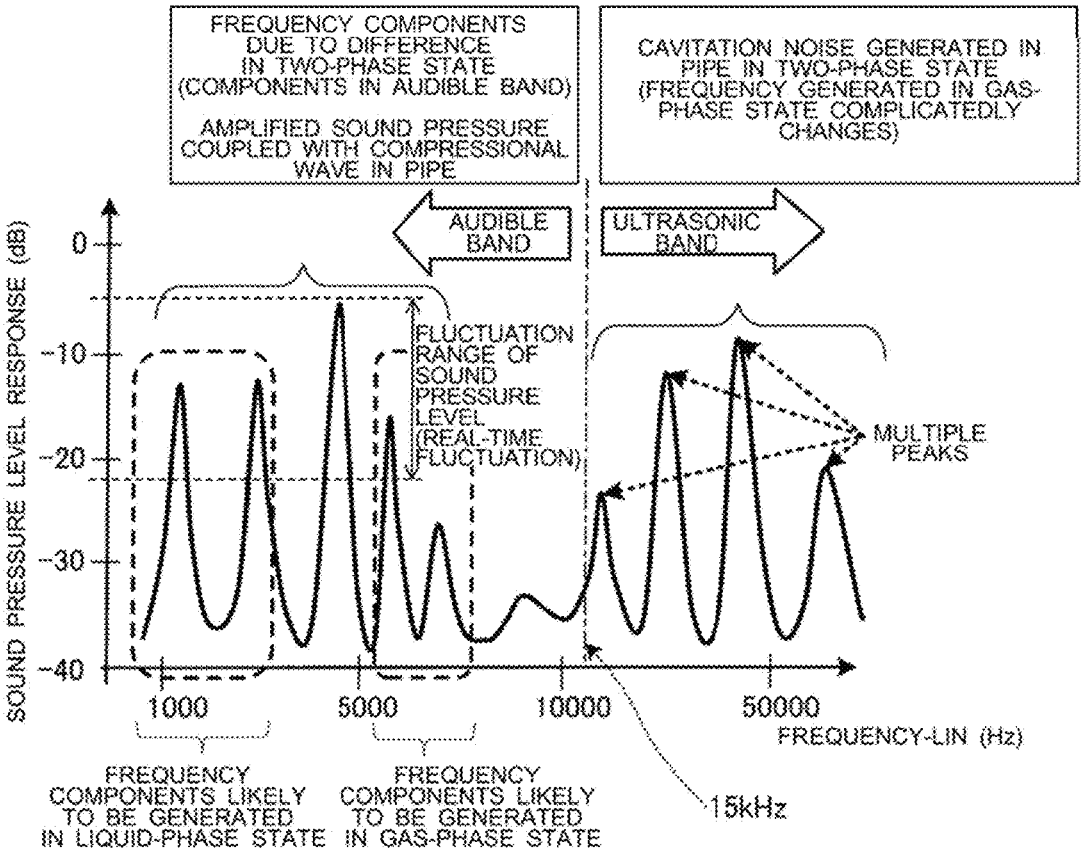
FIG. 3 is an explanatory diagram for illustrating refrigerant flow sound generated from the refrigerant circuit of the refrigeration cycle apparatus according to Embodiment of the present invention.
Figure 4:
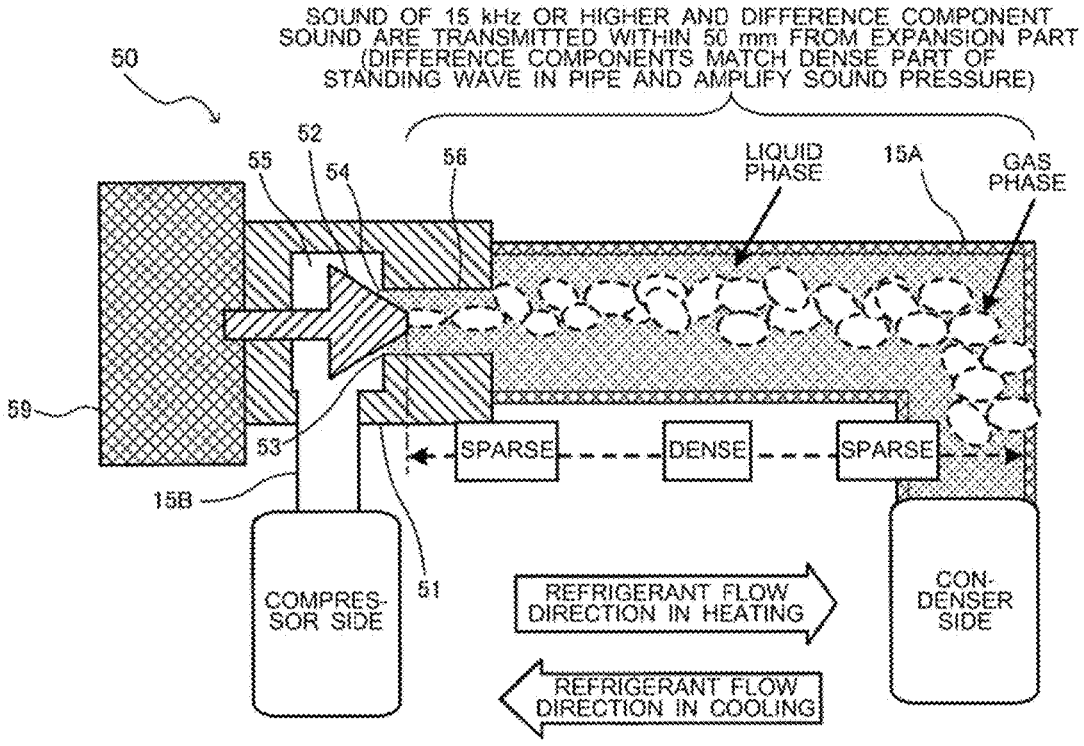
FIG. 4 is a schematic partial sectional view schematically illustrating a state in which two-phase gas-liquid refrigerant is flowing through the electronic expansion valve and a first pipe included in the refrigeration cycle apparatus according to Embodiment of the present invention.
Figure 5:
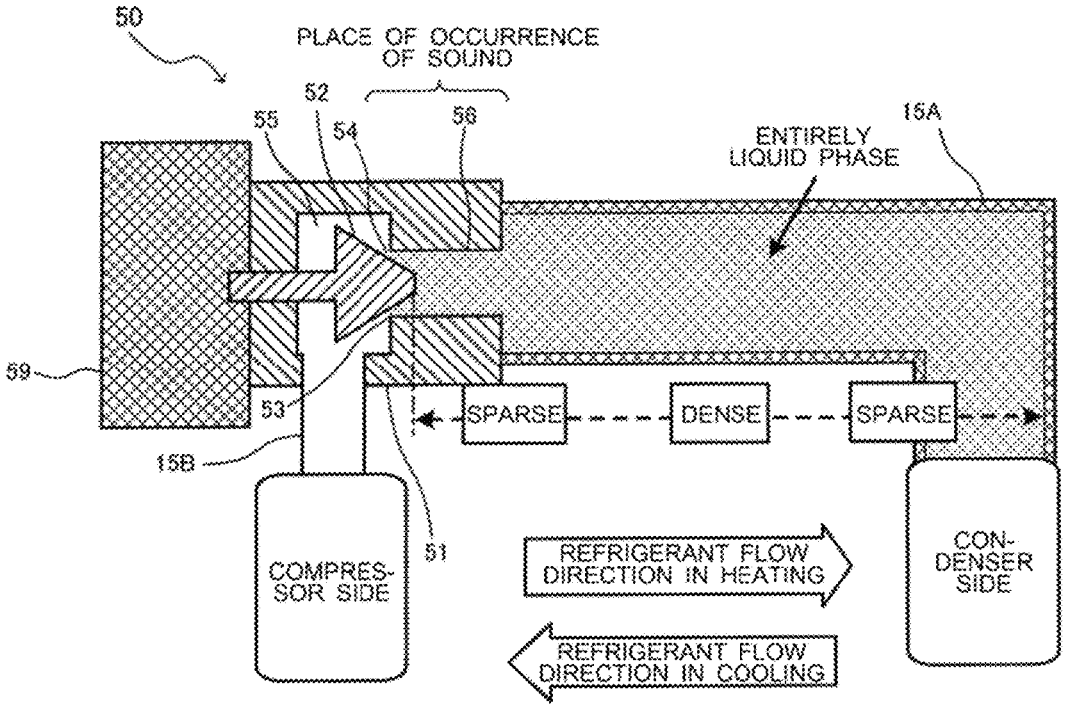
FIG. 5 is a schematic partial sectional view schematically illustrating a state in which liquid refrigerant is flowing through the electronic expansion valve and the first pipe included in the refrigeration cycle apparatus according to Embodiment of the present invention.
Figure 6:
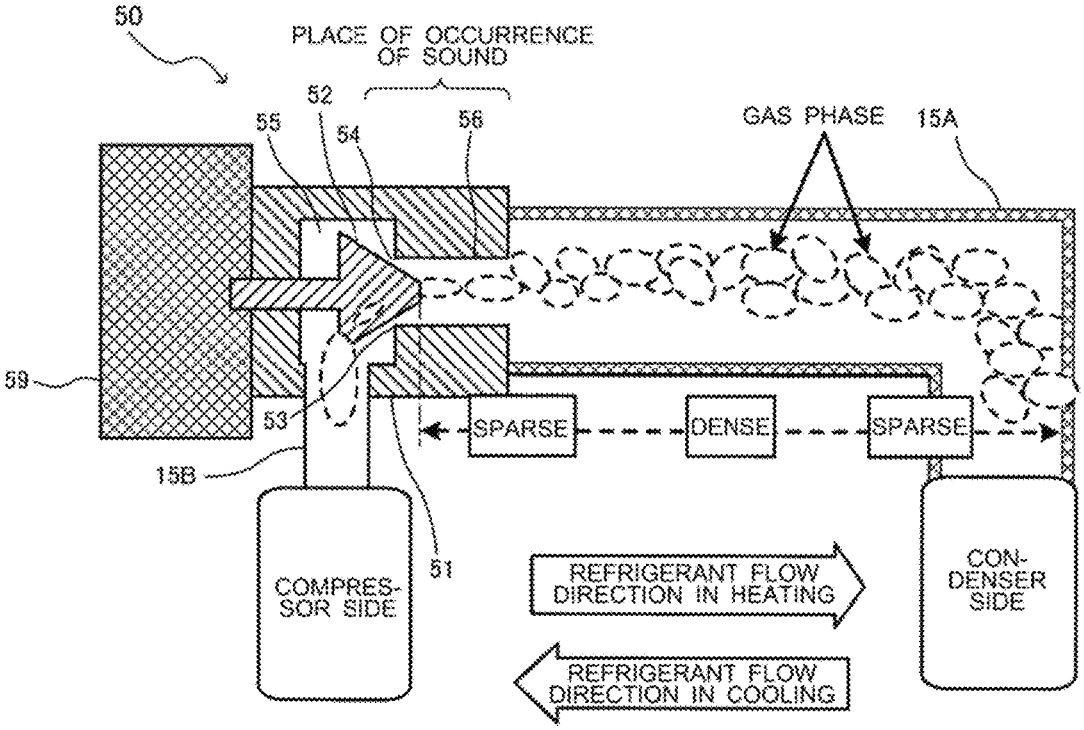
FIG. 6 is a schematic partial sectional view schematically illustrating a state in which gas refrigerant is flowing through the electronic expansion valve and the first pipe included in the refrigeration cycle apparatus according to Embodiment of the present invention.

FIG. 3 is an explanatory diagram for illustrating the refrigerant flow sound generated from the refrigerant circuit of the refrigeration cycle apparatus 100. FIG. 4 is a schematic partial sectional view schematically illustrating a state in which the two-phase gas-liquid refrigerant is flowing through the electronic expansion valve 50 and the first pipe 15A included in the refrigeration cycle apparatus 100. FIG. 5 is a schematic partial sectional view schematically illustrating a state in which the liquid refrigerant is flowing through the electronic expansion valve 50 and the first pipe 15A included in the refrigeration cycle apparatus 100. FIG. 6 is a schematic partial sectional view schematically illustrating a state in which the gas refrigerant is flowing through the electronic expansion valve 50 and the first pipe 15A included in the refrigeration cycle apparatus 100. The refrigerant flow sound generated from the refrigerant circuit of the refrigeration cycle apparatus 100 will be described based on FIGS. 3 to 6.

In FIG. 3, an example of the frequency characteristic of the refrigerant flow sound generated from the refrigerant circuit of the refrigeration cycle apparatus 100 is illustrated as a graph. Further, in FIG. 3, the vertical axis represents the sound pressure level (dB), and the horizontal axis represents the frequency (Hz).

The refrigerant flow sound generated from the refrigerant circuit of the refrigeration cycle apparatus 100 includes impactive vibration sound generated when the refrigerant passes through the electronic expansion valve 50, resonant sound resulting from columnar resonance with a refrigerant pipe 15 when the refrigerant flows through the refrigerant pipe 15, and impactive vibration sound depending on, for example, the diameters and amount of bubbles in the refrigerant, if any such bubbles are formed in the refrigerant (sound accompanying so-called cavitation phenomenon).

These sounds include vibration sound radiated as a result of vibrating the refrigerant pipe 15 or a component part per se and transmissive sound transmitted and radiated from the inside of the refrigerant pipe 15 to the outside of the refrigerant pipe 15.

As for the transmissive sound, it is generally known that an acoustic damping effect is obtainable when the transmissive sound passes through a surface of a material having a thickness corresponding to the ¼ wavelength of the wavelength of the transmissive sound. If the acoustic energy of the transmissive sound is increased owing to some influence, however, the transmissive sound may fail to be damped even with the thickness corresponding to the ¼ wavelength of the wavelength of the transmissive sound. For example, it is conceivable that the acoustic energy of the transmissive sound is increased owing to the influence of the compressional wave of sound. In the refrigerant pipe 15 having a small diameter and running a long distance, the compressional wave of sound naturally exists in the refrigerant pipe 15. Further, when a dense part of the compressional wave and a dense part of the transmissive sound match each other, the acoustic energy is increased by sound amplification. When the refrigerant pipe 15 is thin, therefore, there is an increased possibility of sound transmission to the outside of the refrigerant pipe 15.

Depending on operation conditions of the refrigeration cycle apparatus 100, the refrigerant in the refrigerant circuit flows in the gas-phase state, then in the gas-liquid two-phase state, and thereafter in the liquid-phase state. The refrigerant in the refrigerant circuit may also flow in the liquid-phase state, then in the gas-liquid two-phase state, and thereafter in the gas-phase state. Under these phase conditions, different refrigerant flow sounds are generated. That is, the refrigerant flow sound generated from the two-phase gas-liquid refrigerant (see FIG. 4), the refrigerant flow sound generated from the liquid-phase refrigerant (see FIG. 5), and the refrigerant flow sound generated from the gas-phase refrigerant (see FIG. 6) are different from each other. This is due to refrigerant conditions causing the sounds. The refrigerants with different phase conditions pass through or collide with the throttle part 54, thereby generating the refrigerant flow sounds.

Particularly when the refrigerant is in the gas-liquid two-phase state, conditions for fluctuating sound are created. The gas-phase part of the refrigerant in the gas-liquid two-phase state may be expressed as a cluster of "bubbles" formed in various diameter sizes. Further, bubbles having substantially small diameters that are those of micro-level sizes, which are in the state of so-called microbubbles. Further, the inside of the refrigerant pipe 15 forming the refrigerant circuit is in a high-pressure state for circulating the refrigerant, and thus acceleration is generated in the refrigerant. When micro-level sized bubbles are formed in the refrigerant in the gas-liquid two-phase state flowing at high speed, the bubbles accelerated with pressure applied thereon are travelling through the refrigerant pipe 15. In this process, the air in the bubbles is pressed.

When the bubbles in such a high-pressure state flow into the electronic expansion valve 50 and collide with the throttle part 54 of the electronic expansion valve 50, the bubbles explode at the throttle part 54. In this process, "sound, that is, noise" called bubble pulse accompanying the cavitation phenomenon is generated. As illustrated in FIG. 3, it was found through frequency analysis, based on acoustic characteristics of the sound, that the frequency of this sound is in a high-frequency band equal to or higher than 15 kHz, that is, an ultrasonic band.

Depending on the diameters of the bubbles, the collision of the bubbles, and the state of the bubbles passing through the throttle part 54, the sound in the ultrasonic band repeats fluctuations, generating various frequencies. These frequencies are generated as pipe vibration, which propagates to the outside of the refrigerant pipe 15 as transmissive sound. The transmissive sound propagating to the outside of the refrigerant pipe 15 reaches inhabitants as unpleasant sound in an audible band. That is, adjacent frequencies of ultrasonic waves with multiple peaks are generated. Components in an ultrasonic band with peaks correspond to sound waves in a nonlinear area, and are generated between adjacent frequencies as sum and difference frequency components due to a well-known parametric phenomenon.

In particular, the difference frequency components generate new frequencies in the audible frequency band. That is, the difference frequency components propagate to the liquid-phase refrigerant or the gas-phase refrigerant flowing through the refrigerant pipe 15, and generate sound from a part of the refrigerant circuit different from the place of occurrence of vibration. This is radiated as sound (noise) and delivered to the inhabitants as the unpleasant sound. This phenomenon is one reason for taking measures against vibration alone failing to provide measures against the entire refrigerant flow sound.

Further, as illustrated in FIG. 3, a plurality of frequencies attributed to the cavitation are generated in an ultrasonic band equal to or higher than 15 kHz. Difference components of these frequencies are generated in an audible band from 1 kHz to 8 kHz. When the temperature in the refrigerant pipe 15 is 20 degrees Celsius, the wavelength of 15 kHz is 0.023 m (one wavelength) based on a relationship: C (sound velocity)=f (frequency)*λ (wavelength).

In the band equal to or higher than 15 kHz, the wavelength is shorter than the above-described numerical value ($C=355+0.6\ t\ (m/S^2)$).

The wavelength of 4 kHz is expressed as wavelength $\lambda=0.087$ m.

With the above-described phenomenon, the refrigerant flow sound is generated as the unpleasant sound both in the liquid-phase state and in the gas-phase state. Frequency components that are likely to be generated in the liquid-phase state are included a band around 1 kHz. The frequency components in this case accompany a swirl flow and a separated flow separated therefrom, which are formed when the refrigerant in the liquid-phase state passes through the throttle part 54. Further, frequency components that are likely to be generated in the gas-phase state are included in a frequency band from 5 kHz to 8 kHz. The frequency components in this case correspond to components of fluid sound generated when the refrigerant in the gas-phase state passes through the throttle part 54, and are based on frequency components of passage sound generated when the refrigerant passes through a substantially narrow space. In both of the phases, few frequency components are generated in the ultrasonic band, and most of the generated frequency components are components in the audible band.

Further, the generated sound also includes sliding sound generated between the refrigerant pipe 15 and the refrigerant. The sliding sound includes vibration components. Therefore, an anti-vibration measure such as that of the existing example serves as a measure against vibration. However, the anti-vibration measure alone is unable to address the frequency components of the sound transmitted from the inside of the refrigerant pipe 15 to the outside of the refrigerant pipe 15 and propagating to another space. That is, an external process to perform some energy exchange process is required as a measure against the radiation of the sound once transmitted to the outside of the refrigerant pipe 15.

The refrigerant flow sound generated in the two-phase state matches the pipe resonance, causing the amplification phenomenon in the dense part of the compressional wave of the sound in the refrigerant pipe 15. Since the refrigerant pipe 15 is normally bent to be mounted in the refrigeration cycle apparatus 100, each of opposite end portions of the refrigerant pipe 15 extending to a bend portion is assumed to be a "closed space." In this case, the compressional wave is defined to have $f=nC/2L$. C, n, and L represent the sound velocity, the order, and the spatial dimension (m), respectively.

On the assumption that the refrigerant is in the two-phase state, when the frequency is 4 kHz, $L=0.044$ m (approximately 4 cm) is calculated from $L=nC/2f$. The refrigerant pipe 15 directly connected to the electronic expansion valve 50 (the first pipe 15A) has a straight pipe portion, which normally measures approximately 5 cm, and in which the dense part of the sound is present. The match with the dense part causes sound amplification. The sound amplification therefore takes place within a 5 cm portion of the refrigerant pipe 15 directly connected to the electronic expansion valve 50 (the first pipe 15A). Even if measures are taken for the electronic expansion valve 50 alone, therefore, a drastic effect is not obtained from the measures.

To make measures against the refrigerant flow sound reliable, therefore, the measures need to address not only the electronic expansion valve 50 but also the refrigerant pipe 15 directly connected to the electronic expansion valve 50 (the first pipe 15A).

<Measures Against Refrigerant Flow Sound Generated from Refrigerant Circuit>

Figure 7:
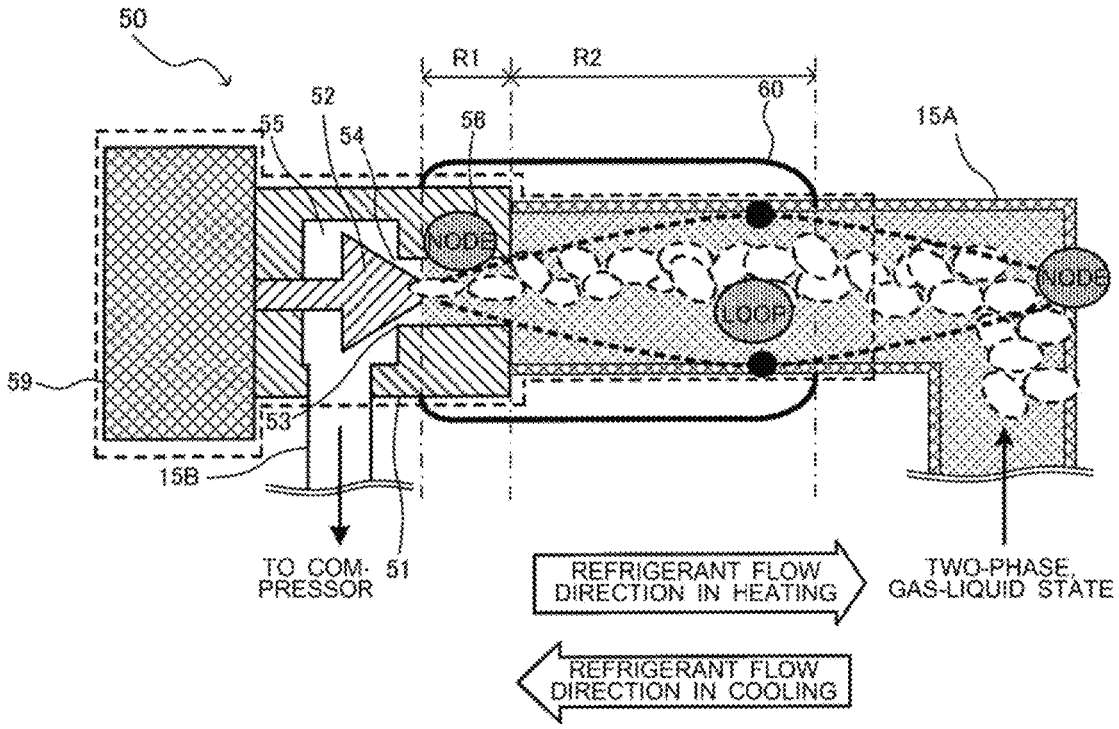
FIG. 7 is a schematic sectional view schematically illustrating an installation example of a transmissive sound suppressing member included in the refrigeration cycle apparatus according to Embodiment of the present invention.
Figure 8:
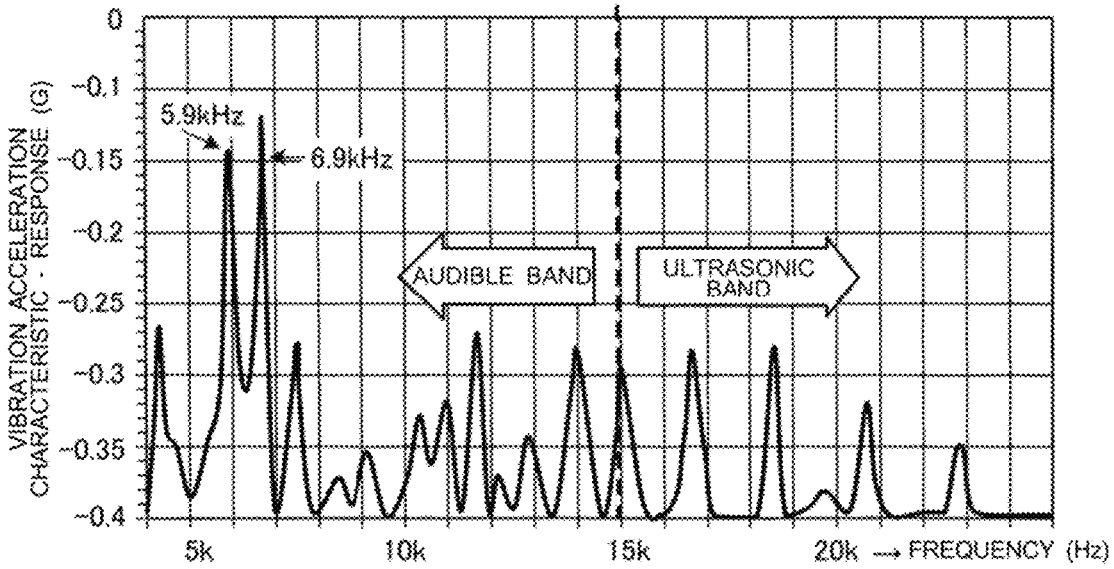
FIG. 8 is a graph illustrating an example of the result of measurement of pipe vibration within 50 mm from the electronic expansion valve when the transmissive sound suppressing member is installed in the refrigeration cycle apparatus according to Embodiment of the present invention.

FIG. 7 is a schematic sectional view schematically illustrating an installation example of a transmissive sound suppressing member 60 included in the refrigeration cycle apparatus 100. FIG. 8 is a graph illustrating an example of the result of measurement of pipe vibration within 50 mm from the electronic expansion valve 50 when the transmissive sound suppressing member 60 is installed in the refrigeration cycle apparatus 100. Measures against the refrigerant flow sound in the refrigeration cycle apparatus 100 will be described based on FIGS. 7 and 8. FIG. 7 illustrates both a state of the refrigerant in the refrigerant pipe 15 and an installation example of the transmissive sound suppressing member 60 based on the contents illustrated in FIG. 2. Further, in FIG. 8, the vertical axis represents the vibration acceleration characteristic (G), and the horizontal axis represents the frequency (Hz).

As described above, an external process for performing some energy exchange process is required against the radiation of the sound once transmitted to the outside of the refrigerant pipe 15. Covering a sound radiation source with a material including air chambers is effective as a measure for efficient heat exchange. Further, as an efficient measure against the sound radiation, it is effective to cover a circumferential portion of the refrigerant pipe 15 directly connected to the electronic expansion valve 50 (the first pipe 15A) with a sound absorbing layer (a sound absorbing material), a sound insulating layer (a sound insulating material (a vibration damping material)), or a sound absorbing and insulating layer (a sound absorbing and insulating material) combining a sound absorbing layer and a sound insulating layer. It is thereby possible to simultaneously address both the audible band and the ultrasonic band with the sound absorbing layer and the sound insulating layer, respectively.

Further, as illustrated in FIG. 8, a frequency band around 6 kHz includes vibration components generated by acoustic excitation by the compressional wave in the refrigerant pipe 15 as one factor. In a frequency band higher than the frequency band, however, prominent vibration frequency components have substantially small responses. It is therefore understood that a frequency equal to or higher than 14 kHz is more likely to be generated as a result of matching the columnar resonance in the refrigerant pipe 15 than to be generated as vibration sound of vibration of the refrigerant pipe 15 accompanying the cavitation of the bubbles exploded at the electronic expansion valve 50.

The refrigeration cycle apparatus 100 is therefore equipped with the transmissive sound suppressing member 60. The transmissive sound suppressing member 60 is positioned at a first region R1, which is defined on an outer side of the first pipe 15A of the electronic expansion valve 50, the first region covering a tip of the valve body 52 of the electronic expansion valve 50, and a second region R2, which is continuous to the first region R1 and is defined on an outer side of a portion of the first pipe 15A including a portion of connection to the electronic expansion valve 50.

Further, the transmissive sound suppressing member 60 is disposed to cover the entire circumferences of the first region R1 and the second region R2. It is thereby possible to suppress the radiation of sound propagating to the outside from the entire circumferences of the first region R1 and the second region R2.

The transmissive sound suppressing member 60 may be formed with a sound absorbing material including air chambers. The sound absorbing material functions to convert the frequency components in the audible band into heat energy to consume sound components in the audible band. The sound absorbing material is formed with a base material made of pulp-based fiber, for example. Specifically, it is possible to form the sound absorbing material by compression-molding a material such as bioplastic, which is pulp-based fiber. Therefore, there is no concern of causing an issue such as mesothelioma due to fiber dispersed from a material, as compared with an existing sound absorbing material made of a material such as glass fiber.

In a cross section of the pulp-based fiber, multiple air holes are formed. Therefore, the sound absorbing material molded with the pulp-based fiber has more air chambers than those of a sound absorbing material molded with another type of fiber, and thus attains a high sound absorption rate. Further, a surface of the sound absorbing material may be provided with a water-repellent property. It is thereby possible to make the sound absorbing material less likely to absorb moisture generated in the refrigerant pipe 15, and thus to suppress degradation of sound absorption performance. Further, the inside of the sound absorbing material may be impregnated with an anti-mold agent. It is thereby possible to suppress the growth of organisms such as mold even if moisture is absorbed in the sound absorbing material.

Further, the transmissive sound suppressing member 60 may be formed with a vibration damping material containing a dielectric material that converts vibration into heat. The vibration damping material consumes acoustic components transmitted from the inside of the refrigerant pipe 15 to the outside of the refrigerant pipe 15 as heat energy. The vibration damping material functions to perform vibration-to-heat conversion on the acoustic energy to consume the energy. The vibration damping material effectively damps the frequency components in the audible band and particularly the frequency components the ultrasonic band. For example, the vibration damping material is formed by kneading a dielectric material such as carbon into a material such as a polyester-based resin. Further, a material such as a piezoelectric material may be kneaded into the vibration damping material. It is thereby possible to perform heat conversion with frictional heat.

Further, the transmissive sound suppressing member 60 may be formed with two layers of the above-described sound absorbing material and the above-described vibration damping material. In this case, the sound absorbing material is disposed inside (near the refrigerant pipe 15), and the vibration damping material is disposed outside the sound absorbing material. With this configuration, it is possible to reliably damp the acoustic energy components transmitted to the outside of the refrigerant pipe 15 in the first region R1 and the second region R2. Further, this configuration serves as a measure against the entire refrigerant flow sound generated in the first region R1 and the second region R2, and is capable of reducing the discomfort raised in the inhabitants by the unpleasant sound.

Figure 9:
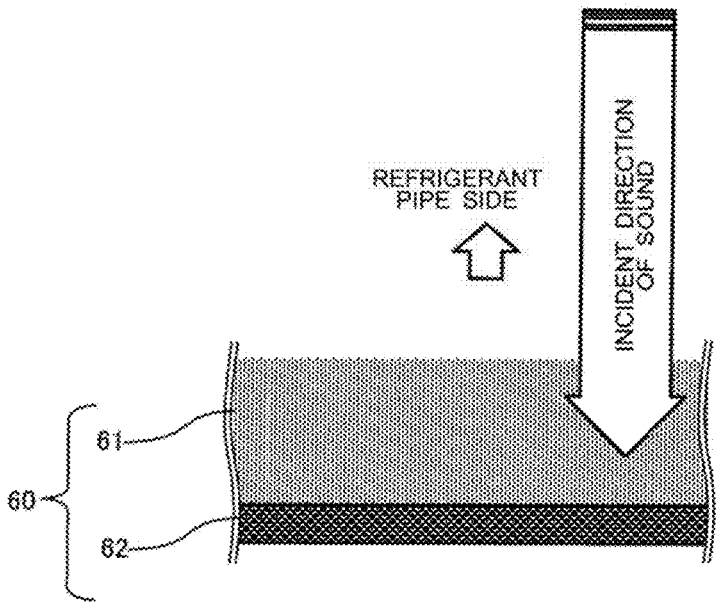
FIG. 9 is an explanatory diagram for illustrating an operation of the transmissive sound suppressing member included in the refrigeration cycle apparatus according to Embodiment of the present invention.
Figure 10:
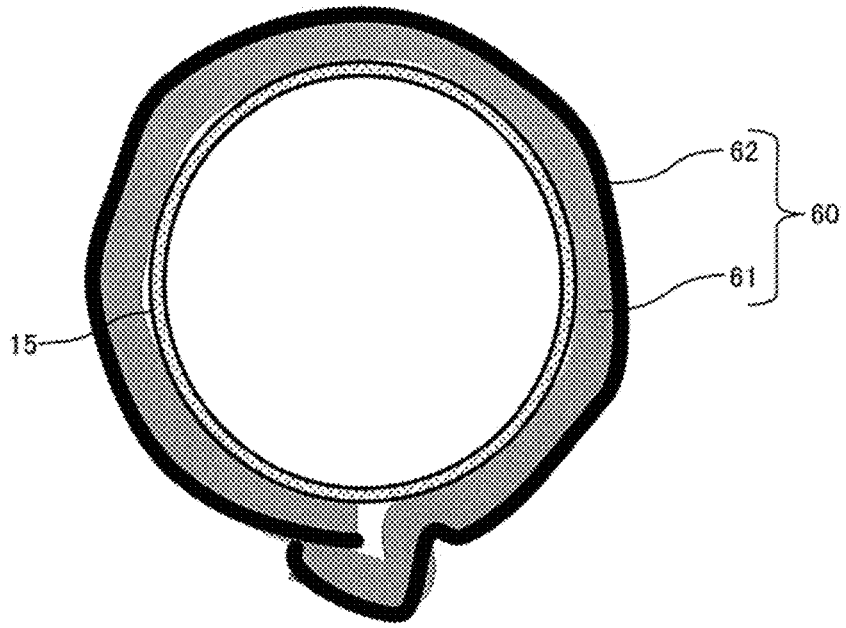
FIG. 10 is a schematic cross-sectional view schematically illustrating a cross-sectional configuration of the transmissive sound suppressing member included in the refrigeration cycle apparatus according to Embodiment of the present invention.

FIG. 9 is an explanatory diagram for illustrating an operation of the transmissive sound suppressing member 60 included in the refrigeration cycle apparatus 100. FIG. 10 is a schematic cross-sectional view schematically illustrating a cross-sectional configuration of the transmissive sound suppressing member 60 included in the refrigeration cycle apparatus 100. The transmissive sound suppressing member 60 formed with two layers of a sound absorbing material and a vibration damping material will be described based on FIGS. 9 and 10.

As illustrated in FIGS. 9 and 10, the transmissive sound suppressing member 60 has a two-layer structure in which a sound absorbing material 61 and a vibration damping material 62 are stacked upon each other.

In this case, as illustrated in FIG. 9, the sound absorbing material 61 is disposed inside (near the refrigerant pipe 15), and the vibration damping material 62 is disposed outside the sound absorbing material 61. With this configuration, it is possible to reliably damp the acoustic energy components transmitted to the outside of the refrigerant pipe 15 in the first region R1 and the second region R2. Further, this configuration serves as a measure against the entire refrigerant flow sound generated in the first region R1 and the second region R2, and is capable of reducing the discomfort raised in the inhabitants by the unpleasant sound.

Further, as illustrated in FIG. 10, the transmissive sound suppressing member 60 is disposed to cover the entire circumferences of the first region R1 and the second region R2. It is thereby possible to suppress the radiation of the sound propagating to the outside from the entire circumferences of the first region R1 and the second region R2. The sound absorbing material 61 is not required to be stuck on the outer circumferential surface of the refrigerant pipe 15, and there may be an air gap between a surface of the sound absorbing material 61 near the pipe and the outer circumferential surface of the refrigerant pipe 15. The air gap makes it possible to further improve the sound absorption effect.

A further specific description will be given.

Figure 11:
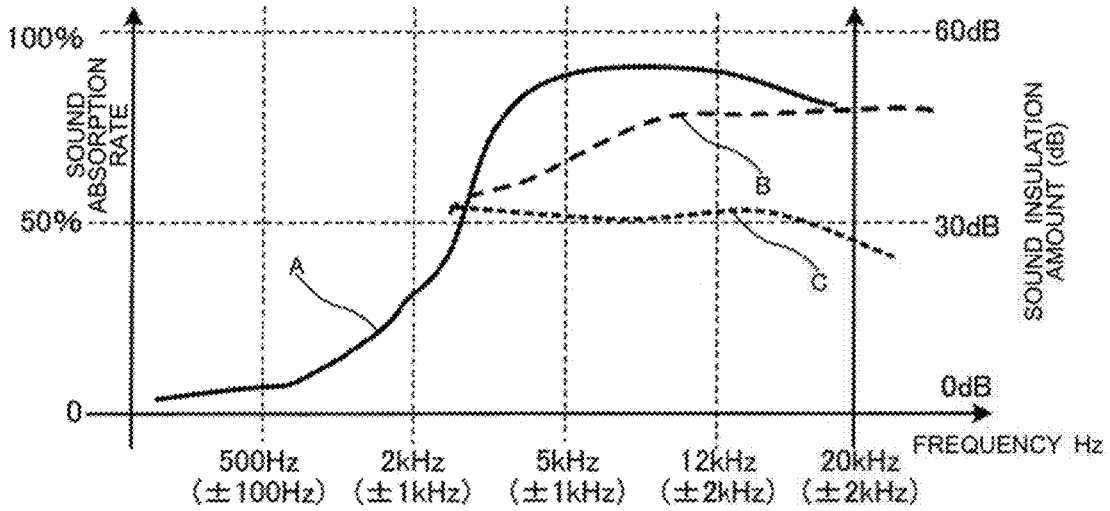
FIG. 11 is a graph for illustrating characteristics of the transmissive sound suppressing member included in the refrigeration cycle apparatus according to Embodiment of the present invention.

FIG. 11 is a graph for illustrating characteristics of the transmissive sound suppressing member 60 included in the refrigeration cycle apparatus 100. In FIG. 11, the left vertical axis represents the sound absorption rate (%), the right vertical axis represents the sound insulation amount (dB), and the horizontal axis represents the frequency (Hz).

The relationship between the sound absorbing material 61 and the vibration damping material 62 is as follows.

The sound absorbing material 61 and the vibration damping material 62 are both related to the wavelength and the output level (pressure=sound pressure level) in the frequency band desired to be reduced.

The sound absorbing material 61 responds to an audible band equal to or lower than 10 kHz.

The vibration damping material 62 responds to an ultrasonic band equal to or higher than 10 kHz.

The sound absorbing material 61 is formed as follows.

One wavelength $\lambda=C/f$ (C represents the sound velocity (340 m/S in the air (when the air temperature is 15 degrees Celsius)), and f represents the frequency (Hz)).

For example, on the assumption that a center frequency of 5 Hz is intended to be reduced, the wavelength in this case is approximately 0.068 m (approximately 7 cm). It is well understood that it is desirable for the sound absorbing material 61 to have a thickness equal to or greater than the ¼ wavelength of the wavelength of the frequency of the sound desired to be absorbed. That is, it is understood through the above-described calculation that, if a frequency around 5 kHz is desired to be reduced, it is necessary to set the thickness of the sound absorbing material 61 to at least 1.75 cm.

When the ideal thickness is viewed in light of an actual electric apparatus (particularly a home electric appliance having a small space therein), however, it is often difficult to secure the ideal thickness in the actual electric apparatus. To enhance the sound absorption effect (increase the sound-to-heat conversion efficiency) of the sound absorbing material 61, therefore, it is important to secure air chambers in the sound absorbing material 61.

The sound absorbing material 61 used as the transmissive sound suppressing member 60 may be formed with a fiber diameter and a manufacturing method capable of ensuring that the weight ratio of the air chambers to the sound absorbing material with respect to the thickness is around 50%. For example, the sound absorbing material 61 may be formed with a fiber diameter of 100μ or less and a manufacturing method based on stacking a fiber material by allowing the fiber material to naturally fall. Further, a material forming the sound absorbing material 61 may be pulp fiber extracted in the form of fiber from a natural pulp material containing fiber in which per se air layers are secured.

It is thereby possible to set a thickness of 5 mm, for example, as the thickness for installing the transmissive sound suppressing member 60 in the internal space of the electric apparatus only having a substantially small space, and to attain a sound absorption effect of 90% or higher in a band around 5 kHz (line A illustrated in FIG. 11).

The vibration damping material 62 is formed as follows.

It is well known that, when the frequency approaches the ultrasound band and the ultrasound band has a sound pressure level equal to or higher than that of the audible frequency band, the sound has a (directional) characteristic with a plurality of narrow directional angles. That the sound in the ultrasonic band therefore has sharp (high) linearity is a well-known fact.

When the source of a sound simultaneously generates another sound in the ultrasonic band, therefore, the sound pressure level may not be sufficiently reduced with the sound absorbing material 61 alone. Further, it is difficult to reduce the pressure of sound (the sound pressure level) in the entirety of a wide frequency band in the substantially small space inside the electric apparatus with the thin sound absorbing material 61 alone. Therefore, the transmissive sound suppressing member 60 uses the vibration damping material 62 as well as the sound absorbing material 61, employing the two-layer structure including the sound absorbing material 61 and the vibration damping material 62.

With the vibration damping material 62, it is possible to further reduce the sound pressure level of the acoustic energy in a high-frequency band with sharp directivity, which is incident through the sound absorbing material 61, with the heat conversion effect of the material. In this case, when the target is particularly an ultrasonic band equal to or higher than 12 kHz, the wavelength is 0.028 m (about 3 cm), the ¼ wavelength of the wavelength is 0.007 m, and a thickness equal to or greater than the ¼ wavelength is effective, as described above.

As described above, however, it is not possible to secure the effective thickness. It is therefore necessary to obtain an effective sound insulation effect with the material forming the vibration damping material 62. Therefore, the pressure of the sound incident on the sound insulating material is comprehended as vibration, and the vibration damping material 62 is formed with a material that effectively converts the vibration energy of the vibration into heat energy, to thereby ensure the sound insulation performance (line B illustrated in FIG. 11). Further, with the use of the piezoelectric effect, too, it is possible to increase the heat conversion efficiency, and even if the material is thin, it is possible to obtain a sound reduction effect equal to or higher than that of a thick dense material such as rubber (line C illustrated in FIG. 11).

As described above, depending on the selection of the manufacturing method and the material, the transmissive sound suppressing member 60 is capable of absorbing and insulating sound with a thickness less than that of an existing transmissive sound suppressing member. It is possible to freely set the thicknesses of the sound absorbing material 61 and the vibration damping material 62, depending on the space for installing the transmissive sound suppressing member 60 and the characteristics of the materials kneaded to form the layers.

Further, the refrigeration cycle apparatus 100 is included in an electric apparatus including a refrigerant circuit having an electronic expansion valve as one of components thereof, such as an air-conditioning apparatus, a hot water supply apparatus, a refrigeration apparatus, a dehumidifier, or a refrigerator, for example.

<Effects of Refrigeration Cycle Apparatus 100>

The refrigeration cycle apparatus 100 includes the electronic expansion valve 50 including the valve body 52, the first pipe 15A extending along the moving directions of the valve body 52 of the electronic expansion valve 50, and the transmissive sound suppressing member 60 positioned at the first region R1, which is defined on an outer side of the first pipe 15A of the electronic expansion valve 50, the first region R1 covering a tip of the valve body 52 of the electronic expansion valve 50, and the second region R2, which is continuous to the first region R1 and is defined on an outer side of a portion of the first pipe 15A including a portion of connection to the electronic expansion valve 50.

According to the refrigeration cycle apparatus 100, the transmissive sound suppressing member 60 is positioned at the first region R1 and the second region R2. It is therefore possible to address the transmissive sound transmitted from the inside of the refrigerant pipe 15 to the outside of the refrigerant pipe 15 at the respective positions of the first region R1 and the second region R2. That is, it is possible to address the transmissive sound from the refrigerant pipe 15, which is unaddressed by anti-vibration measures such as that of the existing example, and thus to reduce the transmissive sound.

In the refrigeration cycle apparatus 100, the second region R2 is within a range of 5 cm from the portion of connection of the first pipe 15A, the portion of connection being connection to the electronic expansion valve 50.

The refrigeration cycle apparatus 100, therefore, obviates the need to cover the entire refrigerant pipe 15, and is capable of addressing the transmissive sound without increasing work and cost.

In the refrigeration cycle apparatus 100, the transmissive sound suppressing member 60 covers the entire circumferences of the first region R1 and the second region R2.

The refrigeration cycle apparatus 100, therefore, is capable of suppressing the radiation of the sound radially propagating to the outside from the entire circumferences of the first region R1 and the second region R2.

In the refrigeration cycle apparatus 100, the transmissive sound suppressing member 60 is formed with the sound absorbing material 61 including the air chambers, and the sound absorbing material 61 responds to audible band sound and ultrasonic band sound.

The refrigeration cycle apparatus 100 is therefore capable of addressing both the transmissive sound in the audible band and the transmissive sound in the ultrasonic band with the sound absorbing material 61.

In the refrigeration cycle apparatus 100, the transmissive sound suppressing member 60 is formed with the vibration damping material 62 containing the dielectric material that converts vibration into heat.

The refrigeration cycle apparatus 100, therefore, is capable of further reducing the sound pressure level of the acoustic energy in a high-frequency band with sharp directivity by using the heat conversion effect of the material.

In the refrigeration cycle apparatus 100, the transmissive sound suppressing member 60 is formed with the two layers including the sound absorbing material 61 including the air chambers and the vibration damping material 62 containing the dielectric material, and the layer of the vibration damping material 62 forms the outermost portion of the transmissive sound suppressing member 60.

The refrigeration cycle apparatus 100, therefore, is capable of absorbing and insulating sound with a thickness less than that of an existing transmissive sound suppressing member.

In the refrigeration cycle apparatus 100, the sound absorbing material 61 is formed with the pulp-based fiber.

According to the refrigeration cycle apparatus 100, therefore, there is no concern of causing an issue such as mesothelioma due to fiber dispersed from a material, as compared with an existing sound absorbing material made of a material such as glass fiber.

In the refrigeration cycle apparatus 100, the vibration damping material 62 is formed with the dielectric material kneaded into the polyester-based resin.

The refrigeration cycle apparatus 100, therefore, obviates the need to form the vibration damping material 62 with a special material, making it possible to easily form the vibration damping material 62 at low cost.

In the refrigeration cycle apparatus 100, the sound absorbing material 61 is formed with the anti-mold agent.

According to the refrigeration cycle apparatus 100, therefore, even if the sound absorbing material 61 absorbs moisture, it is possible to suppress the growth of organisms such as mold.

In the refrigeration cycle apparatus 100, the vibration damping material 62 is formed with the piezoelectric material.

According to the refrigeration cycle apparatus 100, therefore, heat conversion with frictional heat is also possible.

Further, the electric apparatus according to the present invention includes the above-described refrigeration cycle apparatus. It is therefore possible to address the unpleasant sound generated from the electric apparatus located near inhabitants, and thus to reduce discomfort of the inhabitants.

The electric apparatus may be an air-conditioning apparatus, a hot water supply apparatus, a refrigeration apparatus, a dehumidifier, or a refrigerator, for example.

REFERENCE SIGNS LIST compressor 2 flow switching device 3 first heat exchanger 5 second heat exchanger 6 first air-sending device 7 second air-sending device 15 refrigerant pipe 15A first pipe 15B second pipe 50 electronic expansion valve 51 main body 52 valve body 52*a* cylindrical portion 52*b* conical portion 53 valve seat 54 throttle part 55 valve chamber 56 through-hole 57 through-hole 59 driving device 60 transmissive sound suppressing member 61 sound absorbing material 62 vibration damping material 100 refrigeration cycle apparatus R1 first region R2 second region

The invention claimed is:

1. A refrigeration cycle apparatus comprising:

an expansion device including a valve body, the valve body being configured to control a flow rate of refrigerant;

a pipe having a straight pipe portion connected to the expansion device to extend along moving directions, in controlling the flow rate of refrigerant, of the valve body of the expansion device, the pipe being configured to allow refrigerant of a gas-liquid two-phase state to pass therethrough; and a transmissive sound suppressing member positioned at a first region and a second region, the first region being defined on an outer side of a portion of the expansion device provided on a side of the pipe, the first region covering a tip of the valve body of the expansion device, the second region being continuous to the first region and being defined on an outer side of a portion of the straight pipe portion, the portion of the straight pipe portion being connected to the expansion device, the second region being a region at which a dense part of compressional wave of a resonance sound resulting from columnar resonance with the straight pipe portion is present inside the pipe, the dense part of compressional wave of the resonance sound being a loop part of a standing wave of the resonance sound, the standing wave of the resonance sound being formed by providing a node part of the standing wave of the resonance sound on the tip of the valve body of the expansion device.

2. The refrigeration cycle apparatus of claim 1, wherein the transmissive sound suppressing member absorbs audible band sound and ultrasonic band sound.

3. The refrigeration cycle apparatus of claim 1, wherein the expansion device is an electric expansion valve.

4. The refrigeration cycle apparatus of any one of claim 1, wherein the region at which the dense part of compressional wave of sound is present inside the pipe is within a range of 5 cm from an end of the straight pipe portion, the end of the straight pipe portion being connected to the expansion device.

5. The refrigeration cycle apparatus of claim 1, wherein the transmissive sound suppressing member covers entire circumferences of the first region and the second region.

6. The refrigeration cycle apparatus of claim 1, wherein the transmissive sound suppressing member is formed with a sound absorbing material.

7. The refrigeration cycle apparatus of claim 1, wherein the transmissive sound suppressing member is formed with a vibration damping material containing a dielectric material that converts vibration into heat.

8. The refrigeration cycle apparatus of claim 1, wherein the transmissive sound suppressing member is formed with two layers including a sound absorbing material and a vibration damping material containing a dielectric material, and wherein a layer of the vibration damping material forms an outermost portion of the transmissive sound suppressing member.

9. The refrigeration cycle apparatus of claim 6, wherein the sound absorbing material is formed with pulp-based fiber.

10. The refrigeration cycle apparatus of claim 7, wherein the vibration damping material is formed with the dielectric material kneaded into a polyester-based resin.

11. The refrigeration cycle apparatus of claim 9, wherein the sound absorbing material is formed with an anti-mold agent.

12. The refrigeration cycle apparatus of claim 10, wherein the vibration damping material is formed with a piezoelectric material.

13. An electric apparatus comprising the refrigeration cycle apparatus of claim 1.

* * * * *